US005396275A

United States Patent [19]

Koike et al.

[11] Patent Number: 5,396,275

[45] Date of Patent: Mar. 7, 1995

[54] METHOD OF INK JET PRINTING ON CLOTH

[75] Inventors: Shoji Koike; Tomoya Yamamoto, both of Yokohama, Japan

[73] Assignee: Canon Kabushiki Kaisha, Tokyo, Japan

[21] Appl. No.: 992,099

[22] Filed: Dec. 17, 1992

[30] Foreign Application Priority Data

Dec. 27, 1991 [JP] Japan ..... 3-346070

[51] Int. Cl.[6] ..... B41J 2/01

[52] U.S. Cl. ..... 347/101; 347/106

[58] Field of Search ..... 346/1.1, 140, 75; 347/101, 106

[56] References Cited

U.S. PATENT DOCUMENTS

| | | | |
|---|---|---|---|
| 4,702,742 | 10/1987 | Iwata et al. | 8/495 |
| 4,725,849 | 2/1988 | Koike et al. | 347/106 X |
| 4,849,770 | 7/1989 | Koike et al. | 347/106 X |
| 4,931,810 | 6/1990 | Iwata | 347/20 X |
| 4,969,951 | 11/1990 | Koike et al. | 347/106 X |
| 5,067,980 | 11/1991 | Koike et al. | 106/22 |
| 5,075,699 | 12/1991 | Koike et al. | 346/1.1 |

FOREIGN PATENT DOCUMENTS

| | | | |
|---|---|---|---|
| 3434875 | 10/1985 | Germany | B41J 3/04 |
| 41240 | 3/1980 | Japan | B41J 3/04 |
| 61-6366 | 1/1986 | Japan | B41M 5/00 |
| 2-47377 | 2/1990 | Japan | B41J 2/01 |
| 1532036 | 6/1977 | United Kingdom | B41F 23/00 |

OTHER PUBLICATIONS

Derwent (WPIL) Abstract No. 87-239026 with respect to Japanese Patent Document No. 62162086 (Jul. 17, 1987).

*Primary Examiner*—Joseph W. Hartary

*Attorney, Agent, or Firm*—Fitzpatrick, Cella, Harper & Scinto

[57] ABSTRACT

An ink jet printing method in which ink is applied to cloth by an ink jet method, having the steps of adjusting the moisture content of the cloth to a value higher than the official moisture regain of the constituent fibers of the cloth by 5 to 100% by weight, applying ink to the adjusted cloth in a recording density of 9 dots/mm$^2$ to 1225 dots/mm$^2$, and wherein an amount of the dye of the ink applied to the cloth is adjusted within the range of 0.025 to 1 mg/cm$^2$, dyeing the cloth with the dye in the ink by heat treatment, and washing out the remaining dye. The method can obtain a sharp color print with high density, high precision and no bleeding and can solve the problem with respect to environmental pollution caused by waste water.

9 Claims, No Drawings

METHOD OF INK JET PRINTING ON CLOTH

BACKGROUND OF THE INVENTION

1. Field of the Invention

The present invention relates to a method of dyeing cloth and printing an image on cloth by an ink jet method, and the cloth produced.

2. Description of the Related Art

Printing methods typically used at the present time for printing on cloth include screen printing and roller printing methods. Since both methods are unsuitable for production of small amounts of various types of goods and cannot readily conform to changes in fashion, there has recently been a demand for establishing an electronic printing system without a printing plate.

Various printing methods employing ink jet recording have been proposed in compliance with the demand and increasing usage expected in various other fields.

Ink jet printing methods for printing on cloth, however, have required meeting the following requirements:

(1) coloring with a high density;

(2) high percentage exhaustion of the dye used for cloth and easy waterwaste treatment after the washing step;

(3) less irregular bleeding caused by color mixture of different colors on cloth; and (4) a simple process.

In order to solve the above problems, a method of mainly adding various additives to ink, a method of previously treating cloth and the like have been proposed. However, these methods have been unable to simultaneously solve all problems (1) to (4) above, and particularly problems (2) and (3).

Japanese Patent Laid-Open Document No. 61-6366 discloses a method of specifying the amount of the ink jetted. However, this method does not easily and satisfactorily solve the problems with respect to density, bleeding and the like by controlling the amount of ink alone because coloring is mainly controlled by the absolute amount of the dye used and the state of the cloth.

Japanese Patent Laid-Open Document No. 2-47377 discloses a method of specifying the range of dot sizes and the absorbance of the ink. However, all of the problems (1) to (4) are not satisfactorily solved. Particularly, the problem with respect to percentage exhaustion is closely related to the interaction between the number of dye seats adsorbed on fibers and the absolute amount of the dye. The problem (2) has not yet been completely solved by prior printing methods.

As described above, although prior printing methods provide means for satisfying each requirement to some extent, there is no ink jet printing method which can simultaneously satisfy all the requirements and which can solve a series of problems with respect to the requirements for obtaining an image of highest quality.

SUMMARY OF THE INVENTION

Accordingly, it is an object of the present invention to provide a printing method which can solve the problems of conventional ink jet printing, i.e., the problems with respect to the formation of a dyed product having sharpness, a high density and high brightness.

It is another object of the present invention to provide a printing method having a high percentage exhaustion, solving the problem in the use of a large amount of dye causing environmental pollution due to the outflow of the dye in the washing step.

These objects can be achieved by the present invention.

The present invention provides an ink jet printing method in which ink is applied to cloth by an ink jet method, comprising the steps below:

(a) The step of adjusting the moisture content of the cloth to a value higher than the official moisture regain of the constituent fibers thereof by 5 to 100% by weight.

(b) The step of applying ink including a dye to the adjusted cloth in a record density which is adjusted within the range of 3 dots/mm×3 dots/mm to 35 dots/mm ×35 dots/mm, and an amount of the dye of the ink applied to the cloth which is adjusted within the range of 0.02 to 1 mg/cm$^2$.

(c) The step of dyeing the cloth with the dye in the ink by heat treatment.

(d) The step of washing out remaining dye.

The present invention also relates to a cloth printed by the ink jet printing method described above, and a method of producing a cloth that is printed by applying ink to the cloth by the ink jet method above.

DESCRIPTION OF THE PREFERRED EMBODIMENTS

The inventors have investigated an ink jet printing method which simultaneously satisfies the above requirements. As a result, the inventors have found that when cloth with a moisture content adjusted to a value higher than the official regain of the constituent fibers by 5 to 100% is used, and when the amount of the ink applied per unit area and the recording density of the ink are controlled, the level dyeing property, percentage exhaustion, bleeding in a color mixture portion of different colors and so on can be significantly improved. This is possibly caused by the following phenomenon.

The positive adjustment of the moisture content causes the water contained in cloth to optimize swelling inside and outside the fibers, and increases the number of the dye seats adsorbed. In addition, when recording is made on the cloth in the above state with the above-described recording density of the ink and amount of the dye applied per unit area, the best use of the characteristics of the cloth can be made. This significantly increases the percentage exhaustion and prevents bleeding.

The present invention is described in more detail below.

Examples of materials which form the cloth used in the present invention include natural and synthetic fibers such as cotton, silk, nylon and polyester fibers and the like. However, natural fibers such as cotton and silk are particularly preferable. The cloth used in the present invention can also include a mixture of the above-described fibers. The above fibers can be used in any one of the forms of fabric, knit, non-woven fabric and the like.

When the yarns and fibers which form the cloth are long and thin and have a large number of twists, they have good physical properties.

According to the present invention, the moisture content of the cloth used is adjusted to a value higher than the official moisture regain of the constituent fibers thereof by 5 to 100% , preferably 6 to 80%, more preferably 7 to 60%. If an increase in the moisture content is 5% or less, remarkable effects on coloring properties and percentage exhaustion cannot be obtained. If an increase in the moisture content is 100% or more, a problem with respect to bleeding occurs.

In the case of mixed fiber cloth, the moisture content can be adjusted on the basis of the fibers having the highest moisture content.

The method of adjusting the moisture content generally comprises the steps of immersing cloth in pure water or any one of various aqueous solutions, squeezing out water by a roller and, if required, drying the cloth. However, the method of adjusting the moisture content is not limited to this.

Examples of various aqueous solutions include an aqueous alkali solution, an aqueous solution of an inorganic salt, an aqueous solution of a water-soluble polymer, an aqueous solution of a reduction inhibitor, an aqueous solution of urea and/or thiourea and the like.

The moisture content of the cloth used is measured in accordance with JIS L 1019. Namely, 100 g of sample is exactly weighed, placed in a dryer at 105±2° C. and dried until the weight of the sample becomes constant. The moisture content of the cloth is calculated by the following equation:

$$\text{Moisture content } (\%) = \{(W - W')/W'\} \times 100$$

(wherein W: weight before drying, W': weight after drying)

The cloth which is previously treated with an alkali substance or the like is dried until the weight thereof becomes constant, is washed with water and then dried again until the weight becomes constant. The weight of the fiber portion alone is measured after drying, and the moisture content is calculated by the following equation:

$$\text{Moisture content } (\%) = \{(W - W')/W''\} \times 100$$

(wherein W'': weight of fiber portion after water washing and drying).

The printing ink used in the present invention comprises coloring matter, water, an organic solvent, additives and so on.

A dye is preferable as the coloring matter, and any dyes having the ability to dye the cloth can be used. Examples of such dyes that can be used include acid dyes, direct dyes, cation dyes, reactive dyes, disperse dyes, vat dyes and the like. At least one of these dyes can be contained in ink and used as ink with various hues. The total amount of the dyes used is generally 2 to 30% by weight, preferably 3 to 25% by weight, and more preferably 4 to 20% by weight, relative to the total weight of the ink.

The amount of the water preferably used as a main component of the ink is 10 to 93% by weight, preferably 25 to 87% by weight, and more preferably 30 to 80% by weight, relative to the total amount of the ink.

Examples of organic solvents include ketones such as acetone, ketoalcohols and the like; ethers such as tetrahydrofuran, dioxane and the like; oxyethylene or oxypropylene addition polymers such as diethylene glycol, triethylene glycol, tetraethylene glycol, dipropylene glycol, tripropylene glycol, polyethylene glycol, polypropylene glycol and the like; alkylene glycols having 2 to 6 carbon atoms such as ethylene glycol, propylene glycol, trimethylene glycol, butylene glycol, hexylene glycol and the like; triols such as 1,2,6-hexanetriol and the like; thiodiglycol; glycerin; lower alkyl ethers of polyhydric alcohols such as ethylene glycol monomethyl (or ethyl) ether, diethylene glycol monomethyl(or ethyl) ether, triethylene glycol monomethyl(or ethyl) ether and the like; lower-dialkyl ethers of polyhydric alcohols such as triethylene glycol dimethyl (or ethyl) ether, tetraethylene glycol dimethyl (or ethyl) ether and the like; sulfolane; N-methyl-2-pyrrolidone; 1,3-dimethyl-2-imidazolidinone and the like.

The content of the organic solvent is generally 3 to 60% by weight, preferably 5 to 50% by weight, relative to the total weight of the ink.

Although the above solvents can be used singly or as a mixture, a most preferable solvent composition contains at least one polyhydric alcohol. It is more preferable to use a solvent system containing thiodiglycol and at least one organic solvent selected from the group consisting of diethylene glycol, triethylene glycol, tetraethylene glycol, dipropylene glycol, tripropylene glycol, tetrapropylene glycol, and mono- or dialkyl ethers thereof with alkyl groups each having 1 to 4 carbon atoms.

The ink of the present invention comprises the above main components and may also include other various additives such as a dispersant, a surfactant, a viscosity modifier, a surface-tension modifier, a fluorescent whitening agent and the like, which can be added according to demand.

Examples of such additives include viscosity modifiers such as polyvinyl alcohol, cellulose, water-soluble resins and the like; various surfactants of a cation or anion type; surface-tension modifiers such as diethanolamine, triethanolamine and the like; a pH controller, a mildewproofing agent and the like.

Since the print obtained by ink jet printing permits a fine pattern to be obtained, as compared with the print obtained by conventional screen or roller printing, the level of performance required in the present invention, e.g., the level of bleed resistance, is considerably higher than that of prior art printing methods in which bleeding becomes a problem. A recording density of 3 dots/mm×3 dots/mm or less increases bleeding due to an increase in the size of ink droplets and is thus unsuitable. A recording density of 35 dots/mm×35 dots/mm or more causes ink droplets to pass through the mesh of cloth and thus makes the adhesion of the ink droplets to the cloth difficult. If the recording density is beyond the above range, therefore, the best use of the good quality of ink jet printing cannot be made, and the effects of the present invention cannot be remarkably exhibited.

If the amount of the dye applied is 0.025 g/cm$^2$ or less, coloring with a high density cannot be easily performed. If the amount exceeds 1 mg/cm$^2$, the remarkable effect of improving percentage exhaustion cannot be obtained.

The aforementioned ink is applied to the cloth having a moisture content which is controlled to the above value. At this time, a known method such as a bubble jet method in which ink droplets are discharged by thermal energy or the like can be used as the ink jet recording method.

In the recording method of the present invention, the recording density on the cloth is controlled within the range of 3 dots/mm×3 dots/mm to 35 dots/mm×35 dots/mm, and the amount of the dye applied is controlled within the range of 0.025 to 1 mg/cm$^2$, preferably 0.04 to 0.7 mg/cm$^2$, and more preferably 0.05 to 0.5 mg/cm$^2$.

In the present invention, at least one kind of ink can be used. In the case of plural colors, the amount of the dye applied is represented by the total amount of the colors, and can be determined by measuring the amount of the ink discharged and the dye concentration in the ink.

A generally known method is used as the heat treatment method for dyeing the cloth with the dyes contained in the ink applied to the cloth, as described above. Examples of known methods include a steaming method, a HT steaming method, thermofix method and the like. When an alkali agent is required for fixing, a heat treatment method such as an alkali pad steam method, an alkali blotch steam method, an alkali shock method or the like can be used for the cloth which has not been previously treated with an alkali.

In the present invention, the cloth which is treated as described above is washed, in order to remove the remaining dyes, by a conventional method.

Examples

The present invention is further described in detail below with reference to examples and comparative examples. The terms "parts" and "%" are "parts by weight" and "% by weight", respectively.

Examples 1 to 5, Comparative Examples 1 to 4

A. Preparation of Ink

Reactive dye inks of four colors and acid dye inks of four colors were prepared. The total weight of each ink was 100 parts.

| 1. Reactive dye ink | |
|---|---|
| Reactive dye | 4 to 20 parts |
| Thioglycol | 24 parts |
| Diethylene glycol | 11 parts |
| Potassium chloride | 0.004 parts |
| Sodium sulfate | 0.002 parts |
| Sodium metasilicate | 0.001 parts |
| Iron chloride | 0.0005 parts |
| Water | 45 to 61 parts |

The dyes used were as follows:

| | |
|---|---|
| Yellow ink | C. I. Reactive Yellow 95 |
| Red ink | C. I. Reactive Red 226 |
| Blue ink | C. I. Reactive Blue 15 |
| Black ink | C. I. Reactive Black 39 |

The above components were mixed, and the pH value of the resultant mixture was adjusted to 8.4 with sodium hydroxide. After agitation for 2 hours, the mixture was filtered by Fluoropore Filter-FP-100 (manufactured by Sumitomo Denko) to obtain an aqueous ink.

2. Acid dye ink

| | |
|---|---|
| Acid dye | 4 to 20 parts |
| Thioglycol | 23 parts |
| Triethylene glycol monomethyl ether | 6 parts |
| Potassium chloride | 0.05 parts |
| Sodium metasilicate | 0.001 parts |
| Iron chloride | 0.0005 parts |
| Zinc chloride | 0.0003 parts |
| Water | 51 to 67 parts |

The dyes used were as follows:

| | |
|---|---|
| Yellow ink | C. I. Acid Yellow 110 |
| Red ink | C. I. Acid Red 266 |
| Blue ink | C. I. Acid Blue 90 |
| Black ink | C. I. Acid Black 26 |

The above components were mixed, and the pH value of the resultant mixture was adjusted to 4.8 with acetic acid. After agitation for 2 hours, the mixture was filtered by Fluoropore Filter-FP-100 (manufactured by Sumitomo Denko) to obtain an aqueous ink.

B. Ink Jet Dyeing Apparatus

Color Bubble Jet Copier PIXEL PRO (trade name, manufactured by Canon) was converted so that the amount of the droplets discharged can be changed.

1. Ink jet method: on-demand type
2. Head voltage: 20 to 40 V
3. Head temperature: 20° to 60° C.
4. Drive pulse width: 3 to 20 μs
5. Drive frequency: 0.5 to 5 kHz
6. Distance between nozzle and cloth: 1 mm
7. Recording density: 16 dots/mm×16 dots/mm (400 dots/inch×400 dots/inch)

C. Cloth

The two kinds of cloth below were used. The moisture content was adjusted by changing the degree of squeezing after water was added to the cloth.

a: Plain narrow cloth (Egyptian cotton 100%, official moisture regain 8.5%)

b: Habutae with 8 momme (silk 100%, official moisture regain 12%)

D. Printing

Solid printing was performed by using the reactive dye black ink and cloth a and the ink jet apparatus with the amount of the dye applied and the moisture content of the cloth, both of which were changed as shown in Table 1. The amount of the dye applied was adjusted by changing the dye concentration in the ink 40 within the range of 4 to 20% by weight and controlling the driving conditions (head voltage, temperature, drive pulse width, frequency) of the ink jet apparatus so as to change the amount of the liquid droplets discharged within the range of 20 to 50 ml and, if required, performing multiple printing. The moisture content of the cloth was adjusted by changing the degree of squeezing after water was added to the cloth. The print obtained was then steamed in an alkali atmosphere at 100° C. for 5 minutes, washed and dried. The sharpness and the bleeding property of the print obtained were evaluated.

The optical density (OD) was measured and used as a criterion of percentage exhaustion. As a result, when the amount of the dye applied was 0.025 to 1 mg/cm$^2$ and the moisture content of the cloth was higher than the official moisture regain by 5 to 100% the sharpness and bleeding resistance property were good. The percentage exhaustion was decided by relative evaluation to the OD value. It was found that the percentage exhaustion is high when the moisture content is higher than the official moisture regain by 5 to 100% and that the percentage exhaustion is decreased when the amount of the dye applied exceeds 1 mg/cm$^2$.

A color image was then printed on the cloth a using each of the reactive dye inks of four colors with an amount of the dye applied of 0.025 to 1 mg/cm$^2$ and a moisture content of the cloth higher than the official moisture regain by 5 to 100%. The printed color image was then steamed in an alkali atmosphere at 100° C. for 5 minutes, washed and dried and evaluated. As a result, all color images were sharp and had no bleeding in color mixture portions of different colors.

TABLE 1

| Example No. | Amount of dye applied ($mg/cm^2$)*1 | (Moisture content of cloth) − (Official moisture regain) (%)*2 | Sharpness *3 | Bleeding property *4 | Optical density (OD) |
|---|---|---|---|---|---|
| 1' | 0.02 | 12.5 | Δ | ○ | 0.23 |
| 1 | 0.025 | 12.5 | ○ | ○ | 0.34 |
| 2 | 0.15 | 12.5 | ○ | ○ | 1.27 |
| 3 | 1.0 | 12.5 | ○ | ○ | 1.53 |
| 2' | 1.5 | 12.5 | ○ | X | 1.53 |
| 3' | 0.15 | 0 | Δ | Δ | 1.03 |
| 4 | 0.15 | 5.0 | ○ | ○ | 1.25 |
| 5 | 0.15 | 100.0 | ○ | ○ | 1.23 |
| 4' | 0.15 | 111.5 | Δ | X | 1.15 |

Example Nos 1', 2', 3' and 4" are Comparative Example Nos.

*1: The amount of the dye applied was determined by the following equation: (amount of droplets discharged) × (number of dots/$cm^2$) × (dye concentration of ink) × (number of times of multiprinting)

*2: The moisture regain was calculated by the following equation: Moisture regain = {W − W')/W'} × 100

W = weight before drying, W'= weight after drying

*3: The sharpness of the pattern obtained was decided by visual observation according to the following criteria: ○: good Δ: slightly poor X: poor

*4: Evaluated by visual observation according to the following criteria: ○: good Δ: slightly poor X: poor

Examples 6 to 10, Comparative Examples 5 to 8

Solid printing was performed by using the above acid dye black inks and cloth b and the ink jet apparatus with the amount of the dye applied and the moisture regain of the cloth, both of which were changed as shown in Table 2 as in Example 1. The thus-obtained prints were steamed at 100° C. for 30 minutes, washed and then dried. The sharpness and bleeding property of the obtained prints were evaluated. The results obtained were substantially the same as those obtained in Example 1.

A color image was then printed on the cloth b using each of the acid dye inks of four colors with an amount of the dye applied of 0.025 to 1 $mg/cm^2$ and a moisture regain of the cloth higher than the official regain by 5 to 100%, followed by after treatment. The thus-printed color images were evaluated. All color images were sharp and had no bleeding in color mixture portions of different colors.

TABLE 2

| Example No. | Amount of dye applied ($mg/cm^2$)*1 | (Moisture content of cloth) − (Official moisture regain) (%)*2 | Sharpness *3 | Bleeding property *4 | Optical density (OD) |
|---|---|---|---|---|---|
| 5' | 0.02 | 18 | Δ | ○ | 0.21 |
| 6 | 0.025 | 18 | ○ | ○ | 0.29 |
| 7 | 0.15 | 18 | ○ | ○ | 1.21 |
| 8 | 1.0 | 18 | ○ | ○ | 1.49 |
| 6' | 1.5 | 18 | ○ | X | 1.50 |
| 7' | 0.15 | 0 | Δ | Δ | 0.98 |
| 9 | 0.15 | 5 | ○ | ○ | 1.19 |
| 10 | 0.15 | 100 | ○ | ○ | 1.18 |
| 8' | 0.15 | 113 | Δ | X | 1.03 |

Example Nos 5', 6', 7' and 8" are Comparative Example Nos.

*1: The amount of the dye applied was determined by the following equation: (amount of droplets discharged) × (number of dots/$cm^2$) × (dye concentration of ink) × (number of times of multiprinting)

*2: The moisture regain was calculated by the following equation: Moisture regain = {W − W')/W'} × 100

W = weight before drying, W'= weight after drying

*3: The sharpness of the pattern obtained was decided by visual observation according to the following criteria: ○: good Δ: slightly poor X: poor

*4: Evaluated by visual observation according to the following criteria: ○: good Δ: slightly poor X: poor

Example 11

Ink jet printing was performed by the same method as that employed in Example 1 with the exception that the recording density was changed to 8 dots/mm×8 dots/mm (200 dots/inch×200 dots/inch) to obtain sharp images without bleeding in color mixture portions of different colors.

Example 12

Ink jet printing was performed by the same method as that employed in Example 6 with the exception that the recording density was changed to 8 dots/mm×8 dots/mm (200 dots/inch×200 dots/inch) to obtain clear images without bleeding in color mixture portions of different colors.

As described above, the ink jet printing method of the present invention is capable of obtaining a sharp color print with high density, high precision and no bleeding.

The present invention can also significantly increase the percentage exhaustion in ink jet printing and can solve the problem of environmental pollution caused by waste water.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet printing method in which ink is applied to cloth by an ink jet method, comprising the steps of:

(a) adjusting the moisture content of said cloth to a value higher than an official moisture regain of the constituent fibers of said cloth by 5 to 100% by weight;

(b) applying ink including a dye to the adjusted cloth in a recording density of 9 dots/$mm^2$ to 1225 dots/$mm^2$, and wherein an amount of the dye in the ink applied to said cloth is adjusted within the range of 0.025 to 1 $mg/cm^2$;

(c) dyeing said cloth with the dye in said ink by heat treatment; and (d) washing out the remaining dye.

2. An ink jet printing method according to claim 1, wherein said cloth in the adjusting step mainly comprises natural fibers.

3. An ink jet printing method according to claim 1, wherein the adjusting step further includes adjusting the moisture content of said cloth to a value higher than the official regain of the constituent fibers of said cloth by 7 to 60% by weight.

4. An ink jet printing method according to claim 1, wherein the applying step further includes applying said dye in an amount adjusted within the range of 0.05 to 0.5 mg/cm$^2$.

5. An ink jet printing method according to claim 1, wherein said applying step further includes applying ink comprising a dye in an amount of 2 to 30% by weight relative to the total weight of the ink, and water in the amount of 10 to 93% by weight relative to the total weight of the ink.

6. An ink jet printing method according to claim 5, wherein said ink in said applying step further comprises an organic solvent in an amount of 3 to 60% by weight relative to the total weight of the ink.

7. Cloth printed by an ink jet printing method in which ink is applied to cloth by an ink jet method comprising the steps of:

(a) adjusting the moisture content of said cloth to a value higher than an official moisture regain of the constituent fibers of said cloth by 5 to 100% by weight;

(b) applying ink including a dye to the adjusted cloth in a recording density of 9 dots/mm$^2$ to 1225 dots/mm$^2$, and wherein an amount of the dye in the ink applied to said cloth is adjusted within the range of 0.025 to 1 mg/cm$^2$;

(c) dyeing said cloth with the dye in said ink by heat treatment; and (d) washing out the remaining dye.

8. A method of producing cloth printed by applying ink to said cloth by an ink jet method, comprising the steps of:

(a) selecting a cloth of at least one of natural and synthetic fibers;

(b) adjusting the moisture content of said cloth to a value higher than an official moisture regain of the constituent fibers of said cloth by 5 to 100% by weight;

(c) applying ink to the adjusted cloth with a recording density of 9 dots/mm$^2$ to 1225 dots/mm$^2$, and wherein an amount of the dye in the ink applied to said cloth is adjusted within the range of 0.025 to 1 mg/cm$^2$;

(d) dyeing said cloth with the dye in said ink by heat treatment; and (e) washing out the remaining dye.

9. A method according to claim 8, wherein said selecting step include selecting a cloth having at least one of cotton, silk, nylon and polyester fibers.

* * * * *

UNITED STATES PATENT AND TRADEMARK OFFICE

CERTIFICATE OF CORRECTION

PATENT NO. : 5,396,275

DATED : March 7, 1995.

INVENTOR(S) : SHOJI KOIKE, et al.

It is certified that error appears in the above-indentified patent and that said Letters Patent is hereby corrected as shown below:

ON THE COVER PAGE

[56] References Cited

U.S. PATENT DOCUMENTS

"4,931,810 6/1990 Iwata" should read
--4,931,810 6/1990 Iwata, et al.--.

FOREIGN PATENT DOCUMENTS

"Germany" should read --Fed. Rep. of Germany--.
"41240 3/1980 Japan" should read
--55-41240 3/1980 Japan--.

COLUMN 2

Line 66, "100% ," should read --100%,--.

COLUMN 6

Line 63, "100%" should read --100%,--.

UNITED STATES PATENT AND TRADEMARK OFFICE

CERTIFICATE OF CORRECTION

PATENT NO. : 5,396,275

DATED : March 7, 1995

INVENTOR(S) : SHOJI KOIKE, et al.

It is certified that error appears in the above-indentified patent and that said Letters Patent is hereby corrected as shown below:

COLUMN 10

Line 26, "include" should read --includes--.

Signed and Sealed this

Twenty-ninth Day of August, 1995

Bruce Lehman

*Attest:*

BRUCE LEHMAN

*Attesting Officer*

*Commissioner of Patents and Trademarks*